United States Patent [19]

Martin et al.

[11] Patent Number: 4,709,360

[45] Date of Patent: Nov. 24, 1987

[54] HYDROPHONE TRANSDUCER WITH NEGATIVE FEEDBACK SYSTEM

[75] Inventors: Robert J. Martin; Claude Sims, both of Orlando, Fla.

[73] Assignee: Sparton Corporation, Jackson, Mich.

[21] Appl. No.: 796,909

[22] Filed: Nov. 12, 1985

[51] Int. Cl.[4] ..... H04R 17/00

[52] U.S. Cl. ..... 367/157; 367/164; 310/316; 310/317

[58] Field of Search ..... 310/316, 318, 366, 332, 310/353; 367/157, 164

[56] References Cited

U.S. PATENT DOCUMENTS

| | | | |
|---|---|---|---|
| 3,562,764 | 2/1971 | Fujishima | 310/366 |
| 4,197,478 | 4/1980 | Silvus | 310/316 |
| 4,277,758 | 7/1981 | Mishiro | 310/316 |
| 4,336,510 | 6/1982 | Miyamori | 310/366 |
| 4,363,993 | 12/1982 | Nishigaki et al. | 310/332 |

FOREIGN PATENT DOCUMENTS 0131117 6/1978 Fed. Rep. of Germany .

*Primary Examiner*—Charles T. Jordan
*Assistant Examiner*—John W. Eldred
*Attorney, Agent, or Firm*—Reising, Ethington, Barnard, Perry & Milton

[57] ABSTRACT

An acoustic transducer, especially adapted for hydrophones, is disclosed. The transducer comprises a piezoelectric ceramic disk with a main or signal electrode, a common electrode and a feedback electrode; negative feedback is provided around an associated amplifier and the transducer. The transducer is useful in either a sonic receiver or a sonic transmitter. Various ceramic disk configurations are disclosed and several electrode configurations are disclosed. The negative feedback minimizes the undesired effects of the high Q characteristic of the piezoelectric ceramic transducer. The transducer exhibits improved frequency response characteristics including increased bandwidth and reduced resonance effects, fixed or linear phase shift over a broad range and improved transient response. Also, the effect of normal manufacturing variations upon sensitivity, frequency and phase response is minimized.

13 Claims, 21 Drawing Figures

Fig-12A
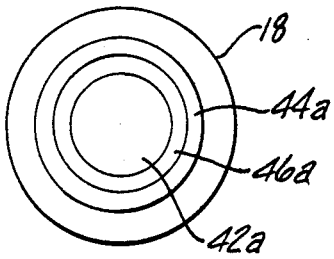
Fig-12B
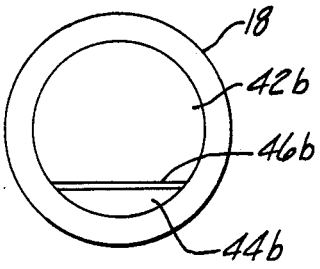
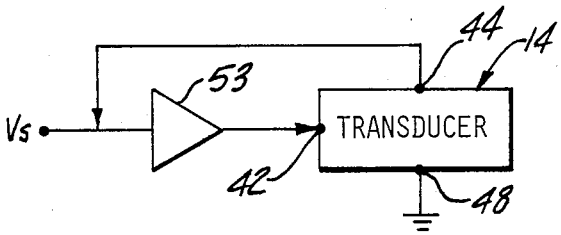
Fig-13
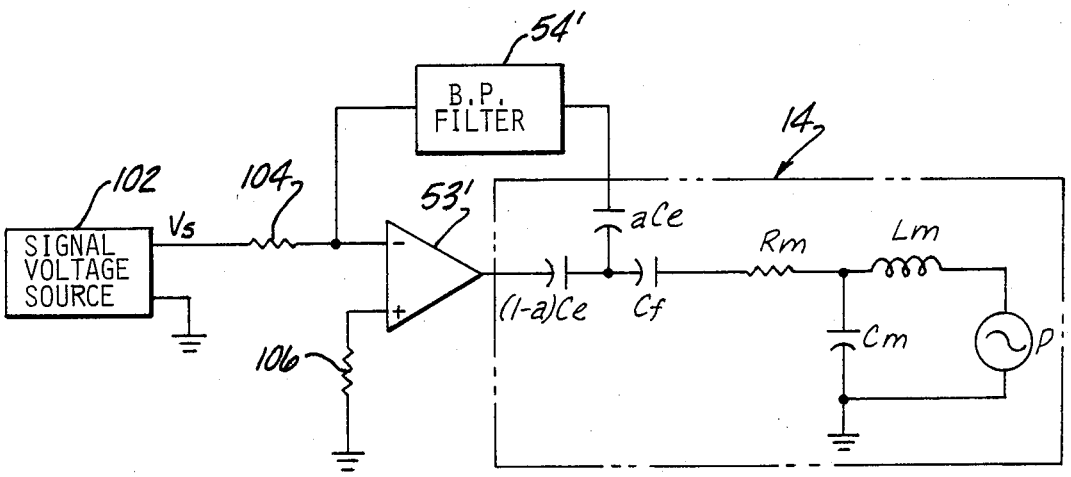
Fig-14

HYDROPHONE TRANSDUCER WITH NEGATIVE FEEDBACK SYSTEM

FIELD OF THE INVENTION

This invention relates to acoustic transducers; more particularly, it relates to such transducers especially adapted for use in hydrophones for sensing and generating sonic waves.

BACKGROUND OF THE INVENTION

Hydrophones have been used for many years for detection and location of ships and submarines and other underwater targets. Hydrophones are also used for sensing sonic waves in underwater geophysical exploration. A transmitting or active hydrophone sends out sonic waves for impingement upon and reflection from an underwater target to determine its location and other information. A receiving or passive hydrophone receives sonic waves from underwater sources such as noise generated by a submarine or sonic waves reflected from an object. A single receiving hydrophone may be used for "listening" for the presence of an underwater object. A combination of transmitting and receiving hydrophones may be used to determine the presence and location of objects by reflection of sonic waves. Hydrophone arrays are used for determining direction, distance and other information about underwater objects.

The transducer in a hydrophone converts such pressure waves to corresponding electrical signals for vice versa, depending upon whether the hydrophone is a receiver or transmitter. The transducer element for producing this conversion is a piezoelectric body which most commonly takes the form of a peizoelectric ceramic material such as lead zirconate titanate or barium titanate. Such ceramic elements are advantageous in that they are highly efficient energy converters and are rugged and can be shaped into suitable configurations. The ceramic element may be used in an associated mechanical structure or it may be configured to serve as the mechanical structure itself as in a bimorph with a pair of ceramic disks bonded to opposite faces of a diaphragm mounted for vibration.

Although piezoelectric ceramic bodies work well as transducers in hydrophones and other applications, the inherent characteristics also produce certain undesirable effects. The high efficiency in converting sonic pressure waves to electrical signals results from the fact that when they are stimulated in a vibratory mode they exhibit a high ratio of stored energy to dissipated energy. This characteristic in an analogous electrical circuit is referred to as "high Q". In the equivalent electrical circuit, the high Q is achieved with inductive and capacitive reactances which are larger compared to the resistance of the circuit. As a result of the high Q, piezoelectric transducers exhibit sharply defined resonance characteristics when exposed to variable frequency sound waves or when stimulated by variable frequency excitation voltage. In other words, the transducer responds strongly at its natural resonant frequency but has a much weaker response to higher and lower frequencies. This can be a serious disadvantage in sonic sensing or sonic generation where a broad spectrum of sound frequencies is to be monitored or generated.

The resonant amplitude response, referred to above, is accompanied by a rapidly changing phase-versus-frequency characteristic. This is an undesirable characteristic especially in an array of hydrophones used to determine direction. In such an application, a fixed or linearly varying phase shift as a function of frequency is desired.

The high Q characteristic of the ceramic transducer also creates a transient response problem when the transducer is driven by an impulsive type of signal, i.e. a signal with an amplitude which increases and decreases very quickly. The transducer responds slowly at the beginning of the signal and continues to respond after the signal input has been terminated. This phenomenon, commonly called "ringing", results in distortion of the output signal relative to the input signal. The poor transient response reduces the intelligibility of received signals and produces errors in distance measurement when hydrophones are used in navigation or sonar systems.

Another problem with hydrophones utilizing ceramic transducers is that of variations in the sensitivity of the transducer resulting from manufacturing variables. This can be overcome by individual calibration but such a procedure is difficult and costly.

In the prior art, attempts have been made to overcome the problems with piezoelectric ceramic transducers; however, such attempts have met with limited success or have resulted in complex and expensive transducers. A common procedure in the prior art is to reduce the electromechanical Q of the transducer by either mechanical or electrical damping. Either method reduces the efficiency of the transducer and results in the need for additional signal amplification and often reduces the signal-to-noise ratio. Also, the amount of damping must be individually matched to the transducer to accommodate variations in transducer characteristics. This procedure is time consuming and expensive.

Also, in the prior art, it has been attempted to reduce the above-mentioned problems by the use of negative feedback in the signal amplifier used with the hydrophone. Negative feedback from the output of the amplifier to the input of the amplifier does not correct for undesired hydrophone characteristics. When a separate hydrophone is included in the feedback loop, the system becomes unstable due to nonlinear transport lag and phase shift and from the mismatch between the two transducers.

An objective of this invention is to overcome certain disadvantages of the prior art piezoelectric ceramic transducers.

SUMMARY OF THE INVENTION

In accordance with this invention, the undesired effects of the high Q characteristic of a piezoelectric ceramic transducer are minimized or eliminated. The invention provides a transducer system which exhibits an increased bandwidth and reduced resonance effects without producing instability in the system. The transducer system also exhibits a fixed or linear phase shift characteristic over a broader range of frequencies than realized in previous systems. Also, it provides a transducer and amplifier system with improved transient response. Also, the invention minimizes the effect of normal manufacturing variations in transducers on overall sensitivity, frequency and phase response, thus permitting uniform calibration even though individual transducers differ in these characteristics.

These and other objects of the invention are accomplished by applying negative feedback around the transducer and an associated amplifier. In accordance with the invention, a plate-like piezoelectric body mounted for vibration is provided with a common electrode on one face, a signal electrode on the other face and signal amplifying means is coupled with the signal electrode. A feedback electrode is provided on one of the faces and feedback means is provided for coupling negative feedback energy through the amplifying means between the signal electrode and the feedback electrode. Further, in the event of undesired electromechanical coupling between the signal electrode and the feedback electrode phase correcting means is coupled between the amplifying means and the feedback electrode. Preferably the phase correcting means is a bandpass filter having a center frequency lower than the resonant frequency of the piezoelectric body.

In one embodiment of the invention, the plate-like piezoelectric body may comprise a single plate or laminated plates of piezoelectric material having the electrodes fixed to the opposite faces thereof. In another embodiment, the plate-like piezoelectric body may comprise a diaphragm with first and second piezoelectric plates bonded to opposite faces thereof; the common electrode is disposed on the outer face of the first plate and the signal electrode and the feedback electrode are disposed on the outer face of the second plate.

In another embodiment of the invention, the electromechanical coupling between the signal electrode and the feedback electrode is substantially eliminated. In this embodiment, the plate-like piezoelectric body comprises a diaphragm, a first piezoelectric plate with one face bonded to one face of the diaphragm, and second and third piezoelectric plates each with one face bonded to the other face of the diaphragm; the common electrode is disposed on the outer face of the first plate, the signal electrode is disposed on the outer face of the second plate and the feedback electrode is disposed on the outer face of the third plate.

The invention is applicable to both sonic energy receivers and sonic energy transmitters. In a receiver, the input of the amplifying means is coupled with the signal electrode and the feedback means couples negative feedback energy from the output of the amplifying means to the feedback electrode. In a transmitter, the amplifying means is adapted to be coupled with an electrical signal source and the output of the amplifying means is coupled with the signal electrode. The feedback means couples negative feedback energy from the feedback electrode to the input of the amplifying means.

A more complete understanding of this invention may be obtained from the detailed description that follows taken with the accompanying drawings.

DESCRIPTION OF THE DRAWINGS

FIGS. 12A and 12B show different electrode patterns;

FIG. 13 is a block diagram of a sonic transmitter according to this invention;

FIG. 14 is an equivalent circuit diagram of a sonic transmitter;

BEST MODE FOR CARRYING OUT THE INVENTION

Figure 1:
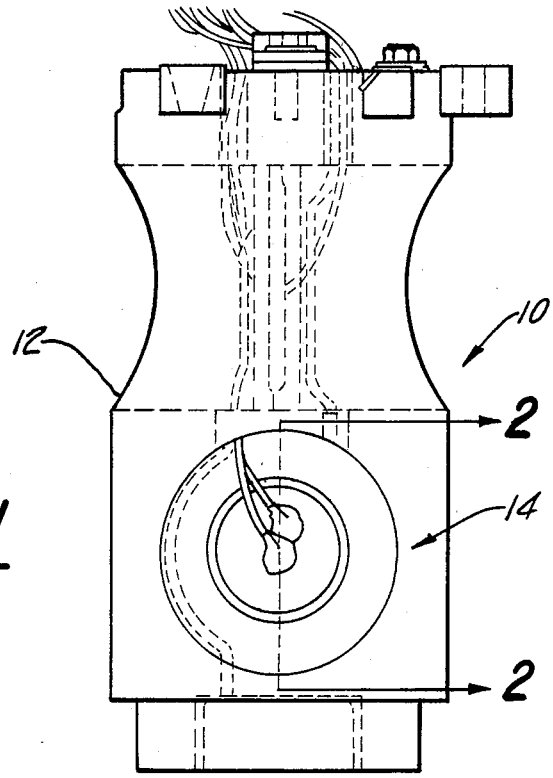
FIG. 1 shows a hydrophone inlcuding a transducer constructed in accordance with this invention.

Referring now to the drawings, there is shown an illustrative embodiment of the invention in a piezoelectric ceramic transducer for use in hydrophones. It will be appreciated as the description proceeds that the invention may be embodied in many different forms and may be used in different applications.

Figure 2:
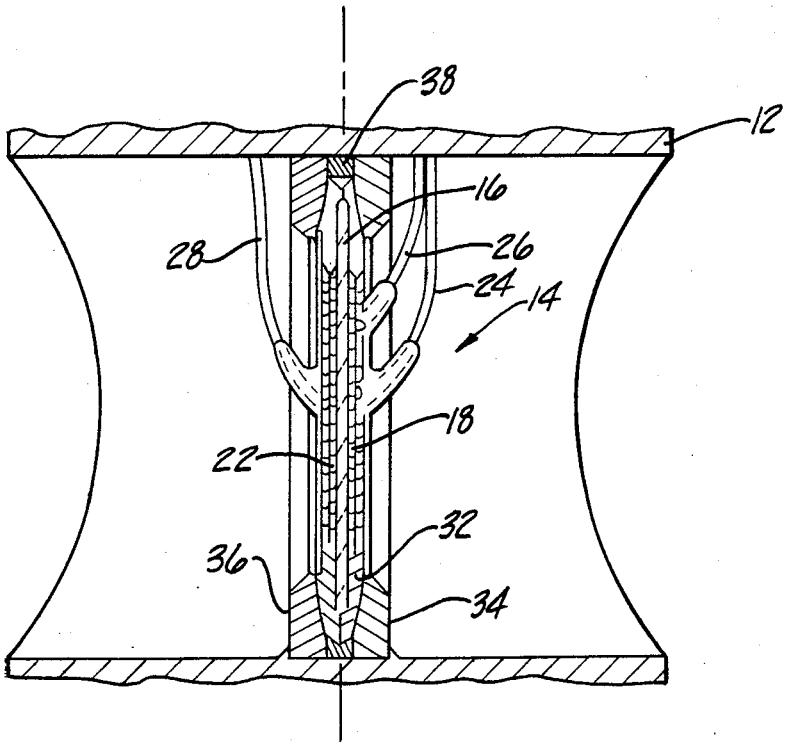
FIG. 2 is a view of the transducer taken on lines 2—2 of FIG. 1.

FIGS. 1 and 2 show a hydrophone 10 which incorporates the transducer of this invention. The housing 12 of the hydrophone is provided with a transverse passage in which the transducer 14 is mounted. The transducer comprises a diaphragm 16 which is constructed as a circular metal disk. A piezoelectric ceramic disk 18, also of circular configuration, is bonded to one face of the diaphragm 16 and a piezoelectric ceramic disk 22 of circular configuration is bonded to the other face of the diaphragm. A pair of lead wires 24 and 26 are attached to discrete electrodes (not shown in FIG. 2) on the surface of the piezoelectric disk 18. Similarly, a lead wire 28 is attached to an electrode (not shown in FIG. 2) on the face of the piezoelectric disk 22. The lead wires extend from the transducer to electronic circuits (not shown) in the housing of the hydrophone. The assembly of the diaphragm 16 and the ceramic disks 18 and 22 constitute a plate-like piezoelectric body, which along with the electrodes and lead wire attachments, are potted or encapsulated in a potting compound which forms water tight capsule 32. The transducer 14 is supported by a pair of annular support rings 34 and 36 which clamp the periphery of the encapsulated diaphragm. The support rings 34 and 36 are rigidly attached to the housing 12 and separated from each other by a spacer ring 38. When the hydrophone is immersed, the surface of the potting compound is in contact with the water. The potting compound is a semi-rigid material that has appropriate sound transmitting properties. Sound waves impinging on it are transmitted to the diaphragm causing it to deflect and vibrate in a sympathetic manner. In this configuration, with the disk constrained around the periphery, maximum deflection occurs at the center of the disk.

Figure 3:
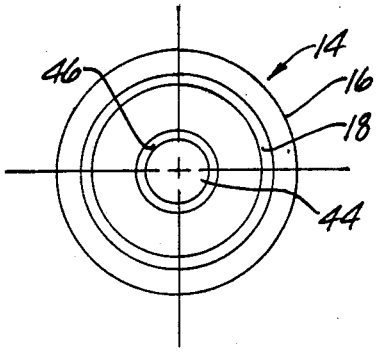
FIG. 3 is a view of one side of a piezoelectric body according to this invention.
Figure 4:
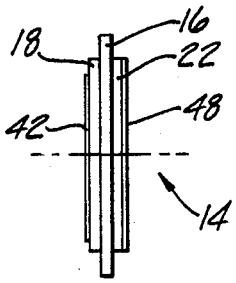
FIG. 4 is an edge view of the body of FIG. 3.
Figure 5:
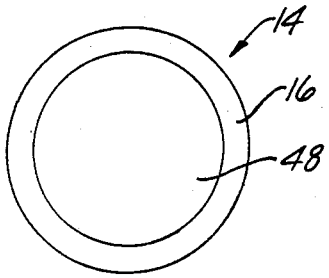
FIG. 5 is a view of the other side of the body of FIG. 3.

The piezoelectric body of the transducer 14 is shown in greater detail in FIGS. 3, 4 and 5. The ceramic disk 18 is bonded to one face of the diaphragm 16 in a known manner. A main or signal electrode 42 of annular configuration and constructed of metal foil is bonded to the outer face of the ceramic disk 18. A feedback electrode 44 of circular configuration is bonded to the outer face of the ceramic disk 18 and disposed within the signal electrode 42 and separated therefrom by an insulating gap 46. The electrodes 42 and 44 are suitably formed on the face of the ceramic disk 18 by applying a single circular foil thereto and etching a ringshaped pattern to provide the insulating gap 46. A ground or common electrode 48, constructed of metal foil is bonded to the outer face of the ceramic disk 22. The lead wire 38 (see FIG. 2) is soldered to the surface of the electrode 48 whereas the lead wires 24 and 26 are soldered to the signal electrode 42 and feedback electrode 44, respectively. Since one surface of each ceramic disk is in contact with the metal diaphragm, the disks are effectively connected in series. The ceramic disks 18 and 22 are polarized so that, when the diaphragm is flexed, the electrical voltages generated by each of the disks are additive to increase the value of the generated signal.

Piezoelectric transducers in general and the transducer of this invention, are useful for both sensing or receiving sound waves and generating or transmitting sound waves. The use of the transducer 14 of this invention in a sound wave receiver is illustrated in the block diagram of FIG. 6. In this circuit, the signal electrode 42 is connected to the input of an amplifier 52 and the common electrode 48 is connected to ground. The output of the amplifier 52 is connected to the feedback electrode 44.

Figure 7:
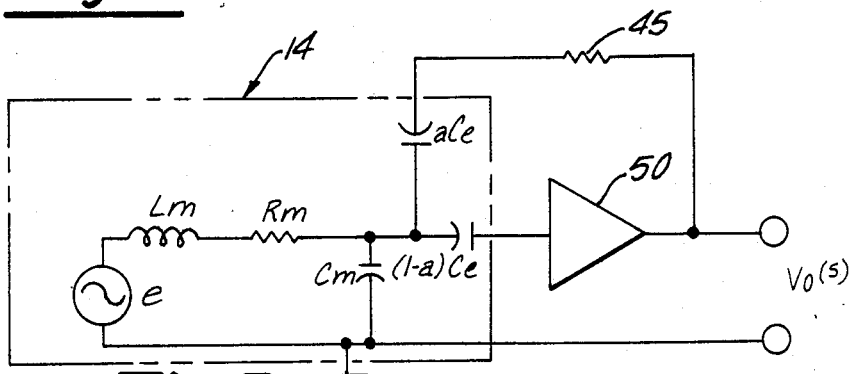
FIG. 7 is an equivalent circuit diagram of a thin disk transducer with an amplifier.

In order to aid in the explanation of the piezoelectric transducer of this invention, it will be helpful to describe the operation and function with reference to an equivalent circuit of the transducer. An equivalent circuit of a ceramic disk transducer utilizing a hypothetical "thin disk" is shown in FIG. 7. This equivalent circuit is an electrical analog of the electromechanical properties of the ceramic transducer. The term "thin disk" is used in this context to mean a ceramic disk which is sufficiently thin so that there is no electromechanical coupling, i.e. piezoelectric coupling, between the signal electrode and the feedback electrode. In present practice, it is not practical to build a thin disk transducer with the signal and feedback electrodes disposed on the same disk. Nevertheless, it will be helpful to first consider the equivalent circuit of a thin disk transducer before considering the equivalent circuit of a thick disk transducer. Subsequently, an embodiment of the invention will be described which exhibits the characteristics of a thin disk transducer.

Figure 6:
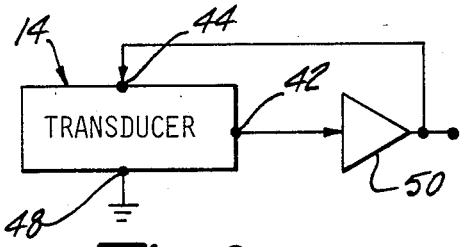
FIG. 6 is a block diagram of a sonic receiver representing the invention.

FIG. 7 is the equivalent circuit of the sound wave receiver as shown in FIG. 6 utilizing the transducer of FIGS. 1 through 5. In this electrical analog, the voltage generator e represents the voltage generated between the signal electrode and the common electrode of the transducer 14. Further, in this analog model, $L_m$ is equivalent to the mass m in the mechanical system, $R_m$ is equivalent to the damping, and the spring factor is represented by the expression, $1/C_m$. The piezoelectric coefficient or conversion factor $H_O$ for the ceramic material provides the mathematical basis for conversion to the electrical analog. The equivalent circuit thus far discribed comprising only the generator e, the inductor $L_m$, the resistor $R_m$ and the capacitor $C_m$ represents the prior art transducer with only two electrodes, namely the signal electrode and the common electrode. Conventional mathematical analysis of this equivalent circuit using the Laplace transform notation yields:

$$\frac{V_O(S)}{P(S)} = \frac{H_O S}{L_m C_m S^2 + R_m C_m S + 1} \text{ volts/pascal} \quad (1)$$

where $L_m$ is the equivalent inductance $C_m$ is the equivalent capacitance $R_m$ is the equivalent resistance $H_O$ is the piezoelectric conversion factor P(S) is the input sound pressure, and S is the Laplace operator=(jw) in the steady state Equation (1) which represents the transfer characteristics of a two-electrode transducer is given only to provide a basis for explaining the operation of the improved transducer of this invention.

As stated above, the circuit of FIG. 7 represents the equivalent circuit of the transducer 14 of this invention as shown in FIGS. 1 through 6 assuming "thin disk" characteristics. The feedback electrode 44 is represented by the capacitor $aC_e$ and the signal electrode 42 is represented by the capacitor $(1-a)\ C_e$. As shown in FIG. 7, the voltage across the capacitor $C_m$ is applied through the capacitor $(1-a)\ C_e$ to the input of an amplifier 50. The output of the amplifier is fed back through a feedback resistor 45 and the capacitor $aC_e$, to the junction of capacitors $C_m$ and $(1-a)\ C_e$. The output voltage $V_o(S)$ is derived between the output of the amplifier and ground. In the actual transducer circuit, the output signal from the signal electrode 42 is amplified by the signal amplifier and a portion is fed back in a degenerative sense to the feedback electrode 44. The feedback voltage is applied through the feedback electrode to the central portion of the transducer as a damping signal. This voltage, through its electromechanical transfer characteristic, produces stresses which oppose the stresses developed by the sound impinging upon the central portion of the transducer.

As mentioned above, the equivalent circuit of FIG. 7 is based upon the assumption that the ceramic disk of the transducer is so thin that there will be no capacitance coupling or electromechanical cross coupling between the signal electrode and the feedback electrode. The equation for the transfer function of the thin disk negative feedback transducer is as follows:

$$\frac{V_O(S)}{P(S)} = \frac{-AH_O S}{L_m C_m S^2 + R_m[C_m + (A+1)aC_e]S + 1} \quad (2)$$

It is noted that equation (2) differs from equation (1) in that the quantity $(A+1)aC_e$ appears in the middle term of the denominator of equation (2) but does not appear in equation (1). This is the damping term of the equation and shows that the Q of the circuit is reduced and the bandwidth is increased. Thus, it is established that a corresponding change is produced in the characteristic exhibited by the transducer itself as a result of negative feedback.

Figure 8:
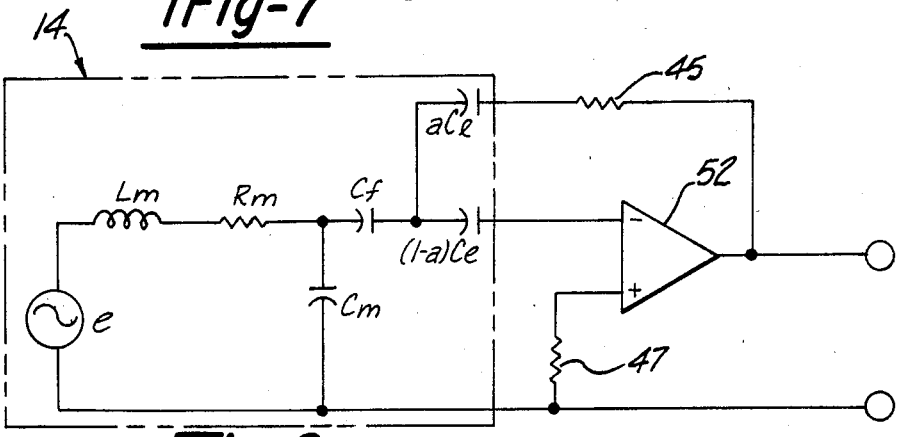
FIG. 8 is an equivalent circuit diagram of a thick disk transducer with an amplifier.
Figure 9:
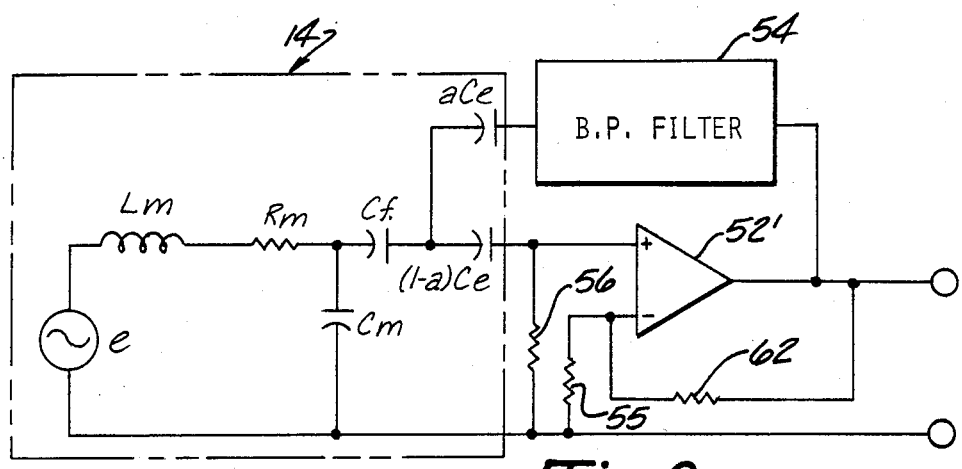
FIG. 9 is an equivalent circuit diagram of a thick disk transducer with an amplifier and bandpass filter.

The foregoing analysis is applicable to a transducer with a thin disk, as discussed above. Further analysis shows that even greater improvement in the hydrophone performance can be achieved by extending the analysis to consider the transducer disk as a thick disk. In practice, the piezoelectric ceramic disk is thick enough that there is actually an electromechanical coupling between the main output electrode and the feedback electrode. The effect of this coupling is represented in the equivalent circuit by the addition of capacitor $C_f$. The equivalent circuit for the thick disk transducer is shown in FIG. 8. The circuit is the same as that of FIG. 7 except that the capacitor $C_f$ is inserted between the resistor $R_m$ and the capacitor $C_{e(1-a)}$. Additionally, the amplifier 52*a* is an operational amplifier with a resistor 47 connected between the noninverting input and ground. The added capacitor $C_f$ tends to make the circuit unstable at desirable amplification levels when the feedback loop is closed. The feedback function has a second order numerator of the form $AS^2+BS+C$. This would cause improper feedback response unless the effect can be cancelled when the feedback loop is closed. In order to insure stability, a bandpass filter is inserted in the feedback path and the feedback resistor is reduced to such a low value that the instabilities of both the input and the feedback transfer functions are eliminated. The equivalent circuit of the stabilized thick disk transducer is shown in FIG. 9. This circuit differs from that of FIG. 8 as follows. A bandpass filter 54 is connected in the feedback path and a feedback resistor 62 is connected between the output and the inverting input of the amplifier 52'. A resistor 56 is connected between the noninverting input and ground and a resistor 55 is connected between the inverting input and ground. This results in the following combined (closed loop) transfer function:

$$H_f = \frac{AH1S}{b_2S^2 + (b_1 + AHC_f)S + 1} \quad (3)$$

where $b_2 = L_m[C_m + C_eC_f/(C_e + C_f)]$
$b_1 = R_m[C_m + C_eC_f/(C_eC_f)]$

Figure 11:
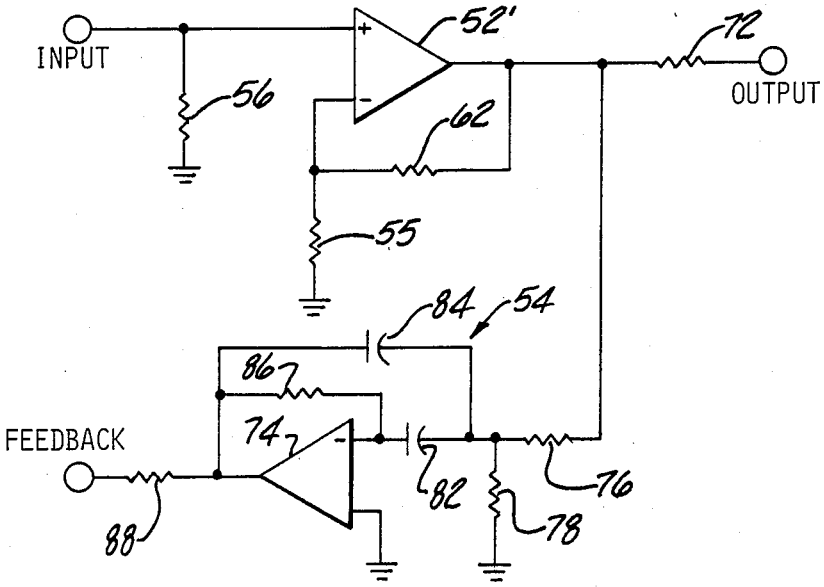
FIG. 11 is a schematic diagram of an amplifier with an active bandpass filter.

The filter 54 in the circuit of FIG. 9 is an active filter; in particular, it is an inverting unity gain amplifier with a bandpass filter as shown in conjunction with the amplifier 52' in the schematic diagram of FIG. 11. In the circuit of FIG. 11 the input signal is applied to the noninverting input of the operational amplifier 52' across the input resistor 56. The output of the op amp 52' is coupled through the feedback resistor 62 to the inverting input of the op amp which is connected to ground through the resistor 55. The output of the op amp 62 is applied through a resistor 72 of the output terminal. The output of the op amp 52' is fed back through the active filter 54 to the feedback electrode. The active filter 54 comprises an op amp 74. The output of the op amp 52' is applied through a voltage divider comprising resistors 76 and 78 and through a capacitor 82 to the inverting input of the op amp 74. The noninverting input of the op amp 74 is connected to ground. The junction of the voltage divider resistors 76 and 78 is connected through a capacitor 84 to the output of the op amp 74. The inverting input is connected to the output of the op amp 74 through a resistor 86. The output of the op amp 74 is coupled through a resistor 88 to the feedback electrode. The center of the filter pass band is preferably lower in frequency than the peak of the transducer frequency response. The values for the components of the active filter are selected so that the bandpass filter corner frequencies are compatible with the desired transducer pass band.

Figure 10:
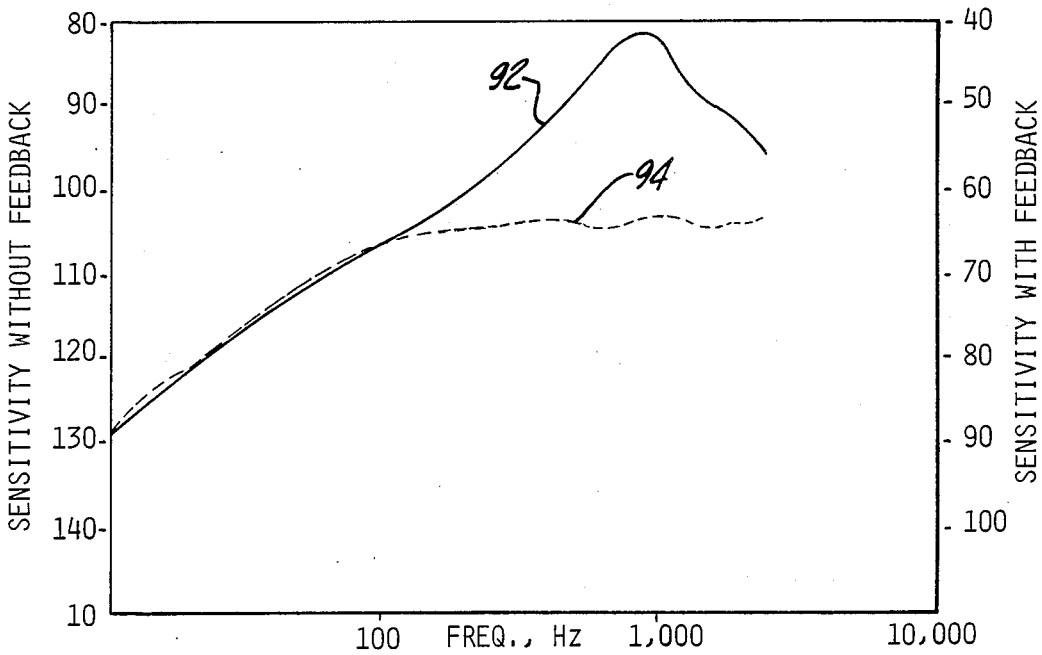
FIG. 10 is a graph showing performance characteristics.

The transducer circuit of FIG. 9 with a transducer 14 of the type shown in FIGS. 1 through 5 and an active bandpass filter 54 as shown in FIG. 11 exhibits an increased bandwidth and a decreased Q. These effects are shown by the sensitivity curves of FIG. 10. In FIG. 10, the curve 92 represents the sensitivity of a transducer without the feedback circuit and the curve 94 shows the sensitivity with the feedback circuit. The reduction of the relative height of the peak of the sensitivity curve shows the reduction in system Q. The flatness of the curve of amplitude as a function of frequency shows that the phase variation is minimized.

It has been found that several different patterns of signal and feedback electrodes may be used with the ceramic bimorph of FIGS. 1 through 5. A first alternative electrode pattern is shown in FIG. 12A in which a signal electrode 42*a* of circular configuration is bonded to the outer face of the ceramic disk 18 and centrally located thereon. A feedback electrode 44*a* of annular configuration concentrically surrounds the feedback electrode 42*a* and is bonded to the outer face of the ceramic disk 18. The electrodes 42*a* and 44*a* are separated from each other by an insulating gap 46*a*. For this pattern, the common electrode (not shown in FIG. 12A) is suitably of circular configuration on the circular ceramic disk, the same as in FIGS. 4 and 5. A second alernative electrode pattern for the signal and feedback electrodes is shown in FIG. 12B. In this pattern, the signal electrode 42*b* is in the shape of a segment of a circle and the feedback electrode 44*b* is in the shape of complementary segment of the same circle with the electrodes being separated by an insulating gap 46*b* extending along the chord of the circle. The common electrode of the bimorph (not shown in FIG. 12B) is of the same configuration as that in FIGS. 4 and 5.

As discussed above, the transducer of this invention is also useful in a sound generator or transmitter, sometimes called a projector. For this purpose, the transducer 14 is connected in circuit as shown in the diagram of FIG. 13. In this circuit, the signal voltage source $V_s$ is connected to the input of an amplifier 53 the output of which is connected to the signal electrode 42 of the transducer 14. Common electrode 48 of the transducer is connected to ground and the feedback electrode 44 is connected to the input of the amplifier 53.

An equivalent circuit of the transducer in a sound projector having negative feedback through a bandpass filter is shown in FIG. 14. This circuit comprises a single voltage source 102 which is utilized for providing an excitation or driving voltage to the transducer 14 through an amplifier 53. The signal voltage output of the source 102 is applied through a resistor 104 to the inverting input of the amplifier 53. The noninverting input of the amplifier is connected through a resistor 106 to ground. The output of the amplifier 53' is connected to the signal electrode 42 of the transducer 14. The common electrode 48 of the transducer 14 is connected to ground. The feedback electrode 44 of the transducer 14 is connected through a bandpass filter 54' to the inverting input of the amplifier 53'. The bandpass filter is suitably of the same type as that described with reference to FIGS. 9 and 11. It will be noted that the transducer 14 is represented in FIG. 14 by its equivalent circuit which is the same as that described with reference to FIG. 9. The transducer generates an output sound pressure p corresponding to the excitation voltage $V_s$. The frequency response characteristic of the transducer is extended and flattened due to the reduction in the Q of the circuit and the benefits of the separate feedback through the piezoelectric disk are essentially the same as those obtained when the transducer is used as a receiver.

Figure 15:
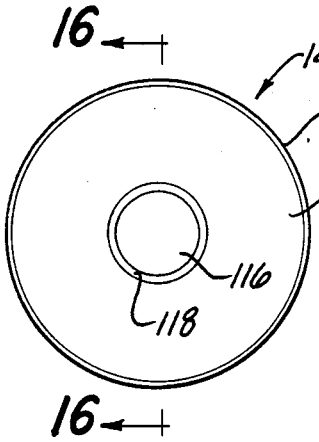
FIGS. 15, 16 and 17 show another embodiment of a piezoelectric transducer.
Figure 16:
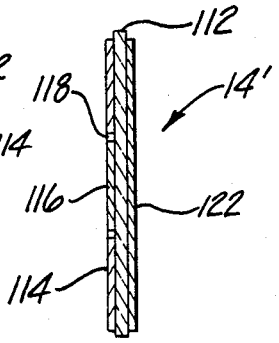
Figure 17:
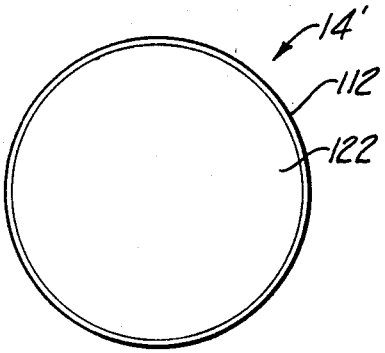

The foregoing description of the invention as represented by FIGS. 1 through 14 has been given with reference to a transducer of the bimorph type. The invention is also useful with the transducer comprising a single piezoelectric ceramic disk or a lamination of plural disks, with or without a supporting diaphragm. FIGS. 15, 16 and 17 show a transducer 14' comprising a single piezoelectric ceramic disk 112 which is self-supporting and adapted to be mounted around it periphery for vibratory motion. A signal electrode 114 of annular configuration is bonded to one face of the disk and a feedback electrode 116 is bonded to the same face and disposed within the electrode 114 and spaced therefrom by an insulating gap 118. The common electrode 122 of circular configuration is bonded to the other face of the ceramic disk 112. The transducer 14' is connected in the same operating circuit as described previously with reference to the transducer 14. Because the transducer 14 exhibits an electromechanical coupling between the signal electrode 114 and the feedback electrode 116, it is preferably used in a circuit with negative feedback through a bandpass filter like that of FIG. 9 or FIG. 14.

Figure 18:
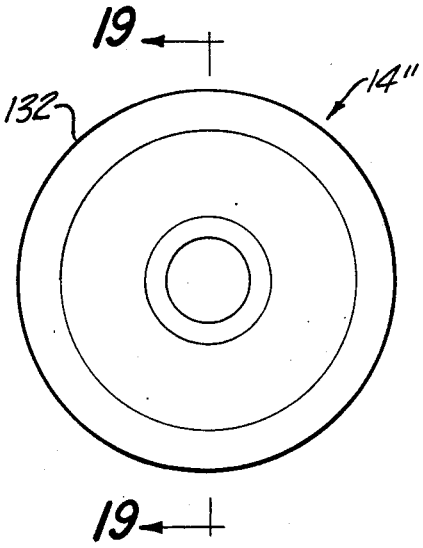
FIGS. 18, 19 and 20 show another embodiment of a piezoelectric transducer.
Figure 19:
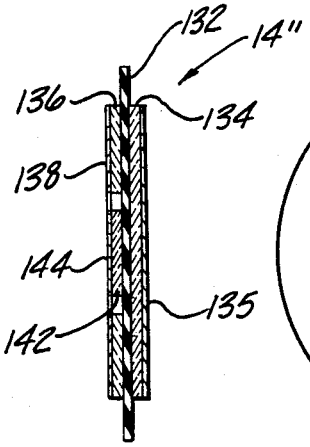
Figure 20:
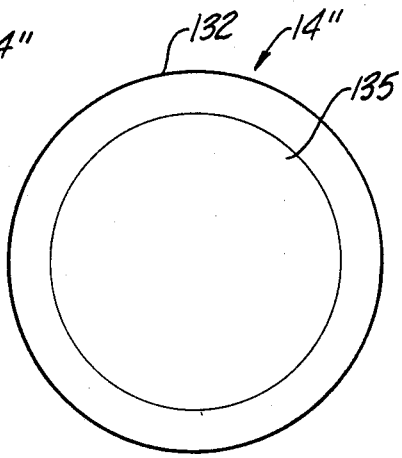

Another transducer 14'' which may be used with this invention is shown in FIGS. 18, 19 and 20. Transducer 14'' is a form of bimorph and comprises a diaphragm 132 adapted to be mounted around its periphery for vibratory movement. A piezoelectric ceramic disk 134 of circular configuration is bonded to one face of the diaphragm and a common electrode 135 is bonded to the outer face of the disk 134. A flat ceramic ring 136 is bonded to the other face of the diaphragm 132 and a signal electrode 138 is bonded to the outer face of the ring 136. A small central ceramic disk 142 of circular configuration is disposed within the ring 136 and is electromechanically isolated from the ring 136 so that there is no electromechanical coupling between the disk 142 and the ring 136. A feedback electrode 144 is bonded to the outer surface of the disk 142. The transducer 14'' exhibits substantially no electromechanical coupling between the feedfack electrode and the signal electrode and hence its behavior approximates that of a thin disk as discussed above. Accordingly, the transducer 14'' may be used in a circuit with negative feedback but without a bandpass filter, such as that represented by FIG. 6 or FIG. 13.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. In a sonic transducer of the type comprising a plate-like piezoelectric body mounted for vibration, a common electrode on one face of the body and a signal electrode on the other face of the body, and signal amplifying means coupled with the signal electrode, the improvement comprising:

a feedback electrode on one of said faces of the body, and feedback means for coupling negative feedback energy through said amplifying means between said signal electrode and said feedback electrode.

2. The invention as defined in claim 1 wherein said feedback electrode is on the same side of the body as the signal electrode.

3. The invention as defined in claim 1 including phase correcting means coupled between said amplifying means and said feedback electrode.

4. The invention as defined in claim 3 wherein said phase correcting means is a bandpass filter having center frequency lower than the resonant frequency of said piezoelectric body.

5. The invention as defined in claim 1 wherein said plate-like piezoelectric body is a circular disk and including means for supporting said disk around its outer periphery.

6. The invention as defined in claim 1 wherein said plate-like piezoelectric body comprises a single plate of piezoelectric material.

7. The invention as defined in claim 1 wherein said plate-like piezoelectric body comprises a diaphragm, a first piezoelectric plate having one face bonded to one face of the diaphragm, a second piezoelectric plate having one face bonded to the other face of the diaphragm, said common electrode being disposed on the other face of said first plate, said signal electrode being disposed on the other face of said second plate and said feedback electrode being disposed on said other face of said second plate.

8. The invention as defined in claim 1 wherein said plate-like piezoelectric body comprises a diaphragm, a first piezoelectric plate having one face bonded to one face of said diaphragm, second and third piezoelectric plates each having one face bonded to the other face of said diaphragm, said common electrode being disposed on the other face of said first plate, said signal electrode being disposed on the other face of said second plate and said feedback electrode being disposed on the other face of said third plate.

9. The invention as defined in claim 1 wherein the input of said amplifying means is coupled with said signal electrode, said feedback means couples negative feedback energy from the output of said amplifying means to said feedback electrode whereby the output of the amplifying means produces an electrical signal in response to sonic energy impinging on said piezoelectric body.

10. The invention as defined in claim 1 wherein the input of said amplifying means is adapted to be coupled with an electrical signal source and the output of the amplifying means is coupled with said signal electrode, and said feedback means couples negative feedback energy from said feedback electrode to the input of said amplifying means whereby said transducer generates a sonic signal.

11. The invention as defined in claim 1 wherein said plate-like piezoelectric body is disk-shaped, said signal electrode means is of annular configuration and said feedback electrode means is of circular configuration within said signal electrode means.

12. The invention as defined in claim 1 wherein said plate-like piezoelectric body is disk-shaped, said feedback electrode means is of annular configuration and said signal electrode means is of circular configuration within said feedback electrode means.

13. The invention as defined in claim 1 wherein said plate-like piezoelectric body is disk-shaped, said signal electrode means being in the shape of a segment of a circle and said feedback electrode means being in the shape of a complementary segment of said circle.

* * * * *

UNITED STATES PATENT AND TRADEMARK OFFICE

CERTIFICATE OF CORRECTION

PATENT NO. : 4,709,360

DATED : November 24, 1987

INVENTOR(S) : Martin et al

It is certified that error appears in the above-identified patent and that said Letters Patent is hereby corrected as shown below:

IN THE SPECIFICATION:

Column 1, line 30, delete "such" and insert -- sonic --.

Line 31, delete "for" and insert -- or --.

Line 35, delete "peizoelectric" and insert -- piezoelectric --.

Column 4, line 32, after "hydrophone" insert -- 10 --.

Column 5, line 7, delete "ringshaped" and insert -- ring-shaped --.

Line 10, delete "38" and insert -- 28 --.

UNITED STATES PATENT AND TRADEMARK OFFICE

CERTIFICATE OF CORRECTION

PATENT NO. : 4,709,360

DATED : November 24, 1987

INVENTOR(S) : Martin et al

It is certified that error appears in the above-identified patent and that said Letters Patent is hereby corrected as shown below:

Column 7, line 4 delete "$C_e$ (1-a)" and insert -- $C_e$ (1 - a) --.

Line 5, delete "52a" should be -- 52 a --.

Line 32, after "(" delete "$C_eC_f$" and insert -- $C_e + C_f$ --.

Signed and Sealed this

First Day of November, 1988

*Attest:*

*Attesting Officer*

DONALD J. QUIGG

*Commissioner of Patents and Trademarks*